United States Patent [19]

Stewart

[11] Patent Number: 4,777,857

[45] Date of Patent: Oct. 18, 1988

[54] MIDI ADDRESS CONVERTER AND ROUTER

[76] Inventor: Benjamin U. Stewart, 19795 Steve Hughes Rd., Walker, La. 70785

[21] Appl. No.: 24,269

[22] Filed: Mar. 10, 1987

[51] Int. Cl.[4] ..... G10H 1/00

[52] U.S. Cl. ..... 84/1.01; 84/1.16

[58] Field of Search ..... 84/1.01, 1.16

[56] References Cited

U.S. PATENT DOCUMENTS

| | | | |
|---|---|---|---|
| 4,176,573 | 12/1979 | Drutsch | 84/1.01 |
| 4,527,456 | 7/1985 | Perkins et al. | 84/1.01 |
| 4,566,362 | 1/1986 | Kikumoto | 84/1.03 |
| 4,681,008 | 7/1987 | Morikawa et al. | 84/1.01 |

*Primary Examiner*—Patrick R. Salce
*Assistant Examiner*—Jeffrey Sterrett
*Attorney, Agent, or Firm*—John F. Sieberth

[57] ABSTRACT

Described is a digital electronic device which selectively intercepts and reroutes the serial data being transmitted between digital music instruments interacting via the MIDI signal standard. Simultaneously, the device performs either transposition or control increment operations by incrementing (or decrementing) only those data bytes which are MIDI addresses of either musical keys or selected controls, (e.g., controls pertaining to volume, pitch bend, tremolo, tone duration, and the like) respectively. The device when equipped with logic gates can operate even faster than a microprocessor-based device performing the same functions, and no programming is required. In fact, a preferred device of the invention built with logic gates and other components available now is capable of operating at 250 kilobaud which is 8 times as fast as the present MIDI baud rate.

20 Claims, 4 Drawing Sheets

MIDI ADDRESS CONVERTER AND ROUTER

TECHNICAL FIELD

This invention relates to electronic keyboards and musical instruments designed to communicate with each other by a digital system called MIDI, and more particularly to an electronic device (hardware) which, when inserted in the communication lines between MIDI instruments can transpose the music and also perform a very useful control increment operation. The device can also route signals from one set of instruments to another in different ways. It is unique and particularly advantageous because in its preferred form in which logic gates are utilized to monitor and to perform logic functions on the data being processed, it can operate even faster than a microprocessor-based device of this invention and no programming is required.

BACKGROUND

MIDI stands for Musical Instrument Digital Interface. It is an internationally accepted standard for signal communication between digital music devices. MIDI signals consist of 8 bit bytes sent serially at a standard rate of 31.25 kilobaud. The most significant bit (MSB) is used to indicate whether the byte is a "Status Byte" (a byte that commands a MIDI Device to perform a certain operation, e.g., "Key On") or a "Data Byte" (a byte that supplies the numerical value of data, e.g., "Key No."). If the MSB is a one then the byte is a Status Byte, otherwise it is a Data Byte. This leaves 7 bits for data which can range from 0 to 127. Numbers larger than 127 require multiple Data Bytes. The 4 least significant bits of a Status Byte indicate the MIDI channel number. This allows 16 different MIDI instruments, each performing different musical parts, to be played by MIDI signals sent over a single cable, because each instrument can be set to respond to all channels or just one selected channel. The remaining three bits of Status Byte (between the MSB and channel number) are used to convey infommation such as Key On, Key Off, Control Change, etc. Control is used to distinguish things like modulation wheel, sustain pedal, volume, etc. from the ordinary keys of a keyboard. When one of these controls is changed the Status Byte 1011cccc is sent by the MIDI system to indicate Control Change, which is then followed by a Data Byte to indicate which control, and one or more Data Bytes to indicate the amount of change. In the above Status Byte and in following statements cccc represents the binary channel number. When a key is pressed, the Status Byte 1001cccc is sent to indicate Key On on channel cccc, which is then followed by a Data Byte to indicate which key, and a third Data Byte to indicate the speed with which it was pressed. When the key is released 1000cccc is sent to signify Key Off on channel cccc followed by a Data Byte to indicate which key. The first Data Byte following a key on, key off, or control change Status Byte is called a MIDI Address since it indicates which key or control was activated. Other Data Bytes are not considered addresses.

Transposing involves the shifting of music from one musical key signature to another. Music written in one key can be transposed up or down any selected number of half tones to sound in another key. The demand for transposers is evident from the fact that there have been over 50 U.S. patents related to transposition. See U.S. Pat. No. 4,176,573 for example. With the MIDI system transposition can be accomplished by recording the MIDI signals with a sequencer, and with the aid of a computer program usually stored in the sequencer's ROM, subtracting or adding the desired amount to each MIDI address which follows a Key On or Key Off Status Byte. Likewise a control increment operation could be performed by incrementing the MIDI address of a control, but most sequencers are not designed to do this. The modified data can then be output so that the desired transposition is accomplished, but with a time lag which in certain situations is intolerable. Signals from MIDI keyboards are often used to play drum machines but most sequencers always transpose all channels by the same amount, i.e., they are not channel selective with respect to transposition. This causes the drums to play incorrectly when music with drum information is transposed. Musicians are also plagued by the fact that the numbering of the controls on MIDI equipment made by different manufacturers is not always the same, and by inconsistencies in equipment made by the same company, e.g., Yamaha's QX1 sequencer addresses the volume control as number 7, but their DX7 Keyboard is incapable of sending volume information to the sequencer because it has no control 7. Musicians with several pieces of MIDI equipment find that routing boxes which can effectively disconnect and reconnect MIDI cables in different ways by just flipping switches are a necessity for efficient operation of the collective equipment. The circuitry to solve the above problems should therefore be housed within a routing box for convenience.

SUMMARY OF THE INVENTION

The present invention solves the above problems with a routing box (designed to meet the demands of a keyboard artist operating a recording studio containing much MIDI equipment) which can also convert one MIDI address to another very quickly. It can therefore be termed a MIDI Address Converter and Router. In a preferred embodiment, MIDI signals entering the device through at least six standard MIDI jacks are converted to normal digital logic signals by high speed opto-isolators. The signals are then routed by switches through buffers to selected output jacks or they may be switched into the MIDI Address Converter, later referred to as MAC, which can either transpose the music or perform a control increment operation. In one preferred form the device includes a switch with two positions (which may be labeled KEY CHANGE and CONTROL CHANGE) which is used to select which operation is performed. The amount of the change is input for example by pressing a button (which may be labeled INCREMENT COUNTER) the desired number of times and preferably this information appears on a LED display. The counter is cleared with a RESET button. A switch with suitably labeled positions such as + and − is used to determine the sign of the increment added to the MIDI Address. And, in this preferred form the device also includes a switch with two positions (which may be labeled 1–8 and ALL) to determine whether the address converter is to affect all channels or only channels 1–8. These controls are readily arranged so that a musician can instinctively operate them as quickly as he does the controls on a keyboard.

A further understanding of the MAC can be obtained by studying its block diagram in FIG. 1 and the more detailed diagram of the Controller in FIG. 2.

It will be seen that this invention provides a digital electronic device which includes electronic means selectively intercepting and rerouting the serial data being transmitted between digital music instruments interacting via the MIDI signal standard. Simultaneously, the device performs either transposition or control increment operations by incrementing (or decrementing) only those data bytes which are MIDI addresses of either musical keys or selected controls, (e.g., controls pertaining to volume, pitch bend, tremolo, tone duration, and the like) respectively. The foregoing and other emodiments of this invention will be still further apparent from the ensuing description, accompanying drawings and appended claims.

It should be emphasized that a major advantages of the MAC is the increase in speed resulting from the use of logic gates, to perform decisions and other logic. In fact, a device of this invention built with logic gates and other components available now is capable of operating at 250 kilobaud which is 8 times as fast as the present MIDI baud rate. An additional advantage of the MAC is that no programming is required. However, for some applications a microprocessor may be used even though it would require extra time to fetch and execute program statements from memory.

Other objects, features and advantages of the invention, and a better understanding of its construction and operation, will be had from the following detailed description of a preferred embodiment (involving use of the MAC), when read in conjunction with the accompanying drawings.

DESCRIPTION OF PREFERRED EMBODIMENT

Figure 6:
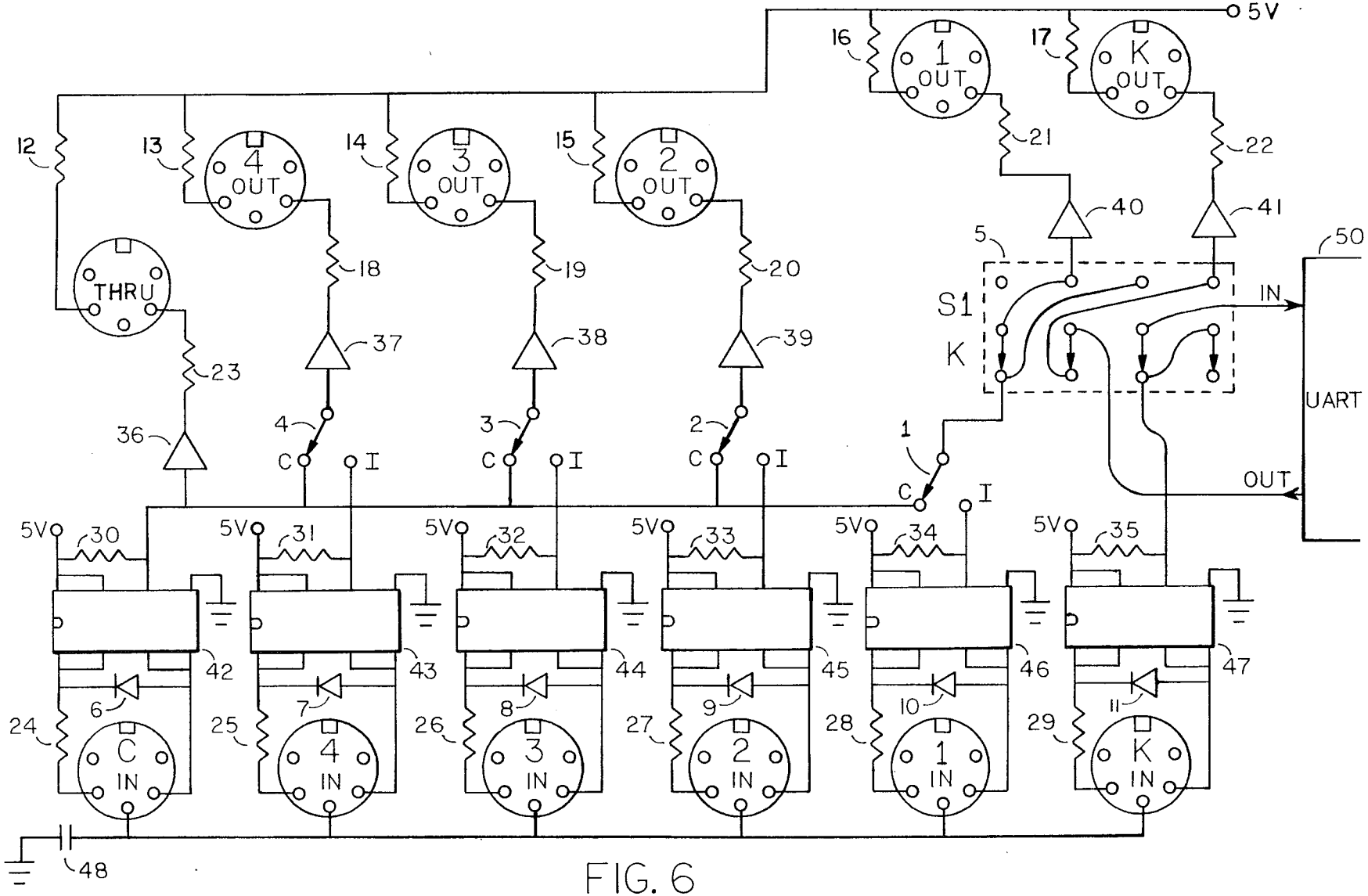
FIG. 6 is a diagram of the Router section of the preferred MIDI Address Converter and Router system of this invention, which section routes signals from selected input jacks to the MAC, and to selected output jacks.

Because in the preferred form depicted signals enter and leave the MIDI Address Converter and Router system through the Router section, the Router section shown in FIG. 6 will be discussed first.

The components in the input and output stages of the Router are determined by the standards of the MIDI system. Signals entering the input jacks in the form of 5 mill current loops, limited by 220 ohm resistors 24 through 29, are converted to normal 5 volt digital signals by opto-isolators 42 through 47, typically pS2007, ECG3087, or equivalent. Diodes 6 through 11, typically 1N4 or equivalent, serve to protect the opto-isolators against accidental voltage of wrong polarity or amplitude. Pull-up resistors 30 through 35 should be about 1000 ohm. In the output stages buffers 36 through 41 should be equivalent to two 74LSO5 inverters connected in series and the current limiting resistors 12 through 23 should be 220 ohm.

The label C on switches 1 through 4 and also on the jack labeled C IN stands for COMMON. The label I on switches 1 through 4 stands for INDIVIDUAL. These terms are routinely used and well understood by users of MIDI gear. The label K on switch 5 and also on the jacks labeled K IN and K OUT stands for Keyboard-controller. A study of the circuit diagram of the Router will reveal the following facts. Signals out of the THRU jack are the same as the signals entering the C IN jack. When switch 2 is in position I signals pass unchanged through it from the 2 IN to the 2 OUT jack, but when it is in position C, signals pass unaltered through it from the C IN to the 2 OUT jack. Similar statements can be made about switches 3 and 4. The K IN signal is routed through the MAC via UART 50 to the K OUT jack when switch 5 is in position K, otherwise the K IN and K OUT signals are equal. The C IN or 1 IN signal selected by switch 1 in position C or I respectively is routed through the MAC to the 1 OUT jack when switch 5 is in position S1, otherwise the 1 OUT and selected signals are equal. The Router can therefore route signals from the C IN, 1 IN, or K IN jacks through the MAC for the desired address conversion.

Figure 1:
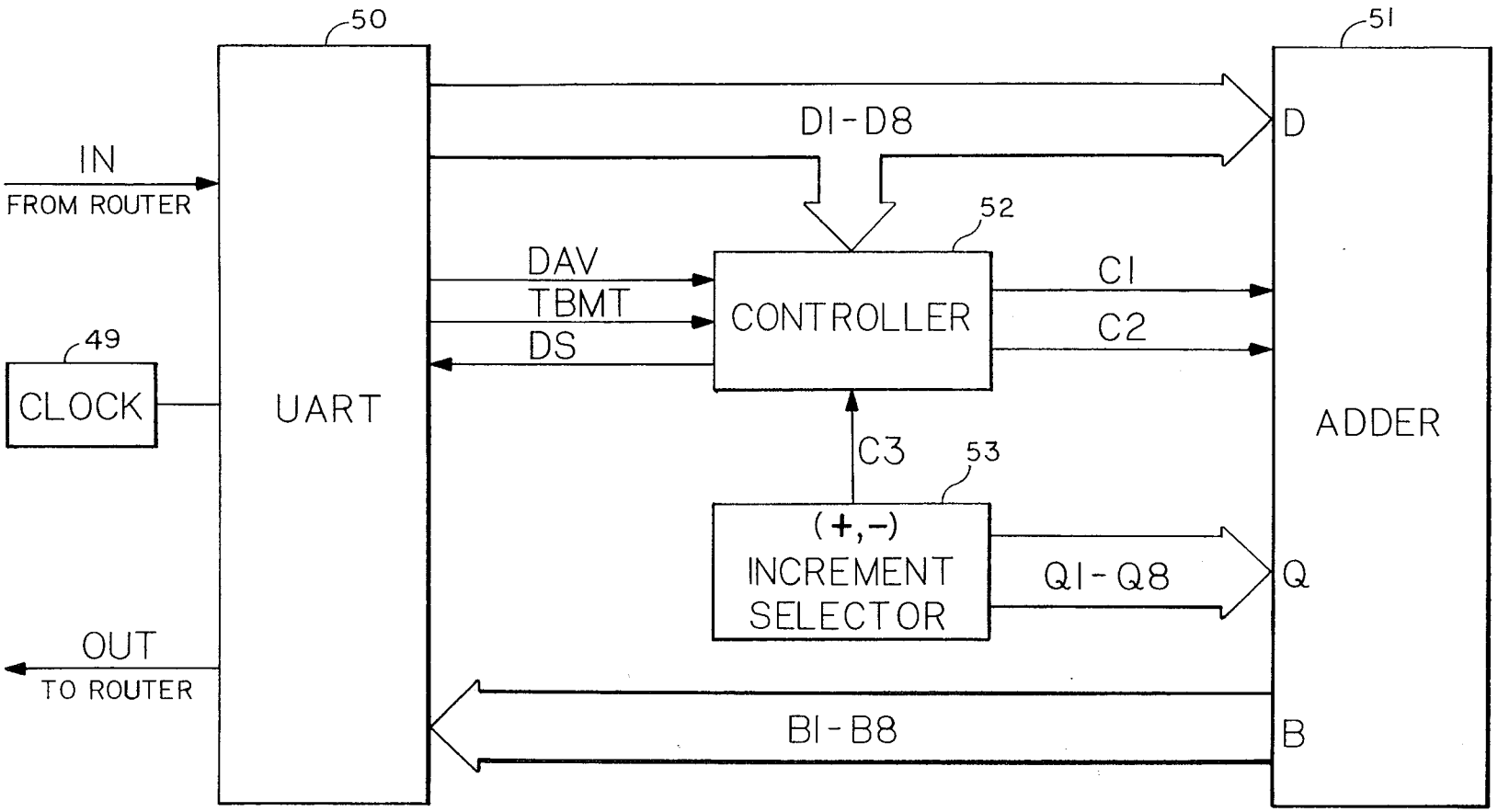
FIG. 1 is a block diagram of the MIDI Address Converter or MAC which is an important part of the preferred overall MIDI Address Converter and Router system of the invention.

Turning now to the MAC, its block diagram, FIG. 1, will be considered first, followed by the details of each block. Serial data from the Router, after conversion to parallel data by UART 50, appears on data bus D1–D8 as byte D input to Adder 51 and Controller 52. The amount to be added or subtracted to a MIDI address is input to the Adder as byte Q from the Increment Selector 53 via bus Q1–Q8. Byte B output by the Adder to the UART via bus B1–B8 depends upon the logic state of control lines C1 and C2. If (C1,C2)=(1,1) then B=D. If (C1,C2)=(0,1) then B=D −Q. If (C1,C2)=(1,0) then B=D+Q+1. Byte B is converted to serial data by the UART and sent back to the Router. The Controller receives information about the sign of the increment via control line C3 on which the voltage is high for plus and low for minus. Referring to the control lines between the UART and the Controller, DAV stands for Data Available, TBMT stands for Transmitter Buffer Empty, and DS stands for Data Strobe. DAV goes high each time a new byte appears on D1–D8. TBMT goes high when the transmitter buffer becomes ready to accept new data. A low going strobe on DS will then cause DAV to go low, and Byte B to be loaded into the transmitter buffer. The rising edge of the strobe will cause transmission to begin and TMBT to go low.

Figure 4:
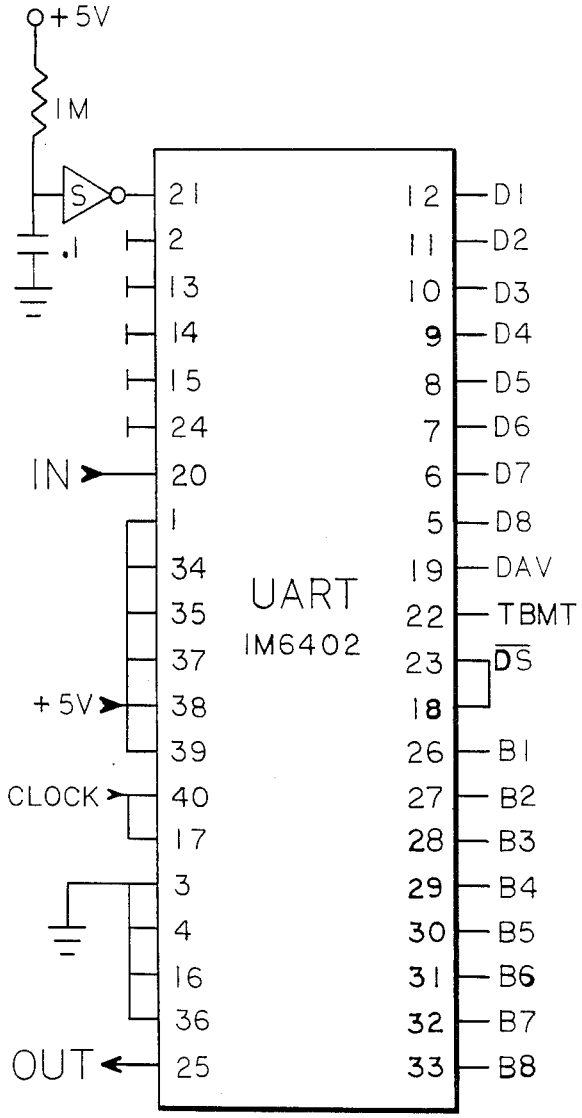
FIG. 4 is a diagram showing detailed connections to all pins of the UART used in the MAC.

The preferred UART is Intersil's IM6402 which is wired into the MAC exactly as shown in FIG. 4. The circuitry involving the Schmitt trigger connected to pin 21 of the UART is required because the IM6402 must be reset after power-up in order to function properly. The frequency of clock 49, FIG. 1, should be 500 kilohertz so that the UART will operate at 31.25 kilobaud as required by MIDI standards.

Figure 5:
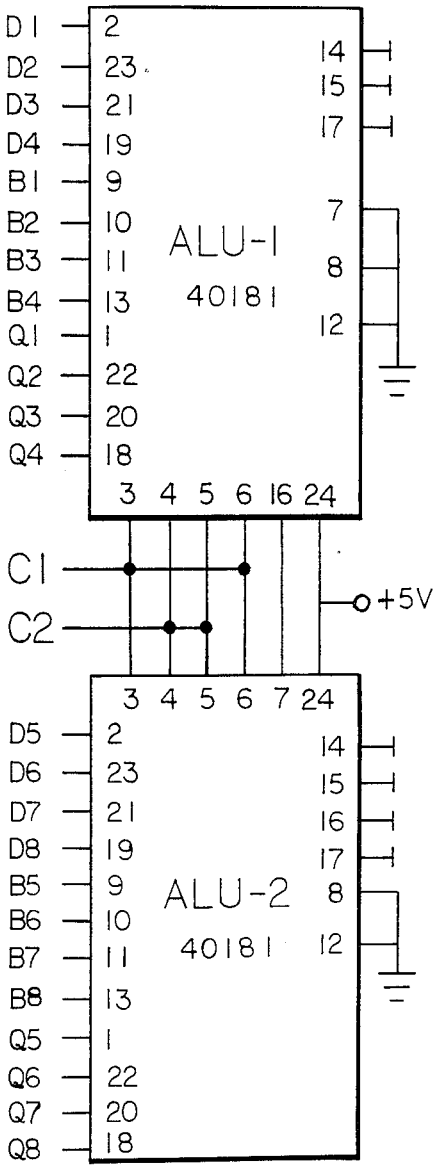
FIG. 5 is a detailed schematic of the Adder section of the MAC.

The Adder, which must also be able to subtract, may be built with EXCLUSIVE OR gates, etc., but it is most conveniently constructed with two of RCA's 40181 Arithmetic Logic Units connected and wired into the MAC as shown in FIG. 5. It will then function as stated above with regard to control lines C1 and C2.

Figure 2:
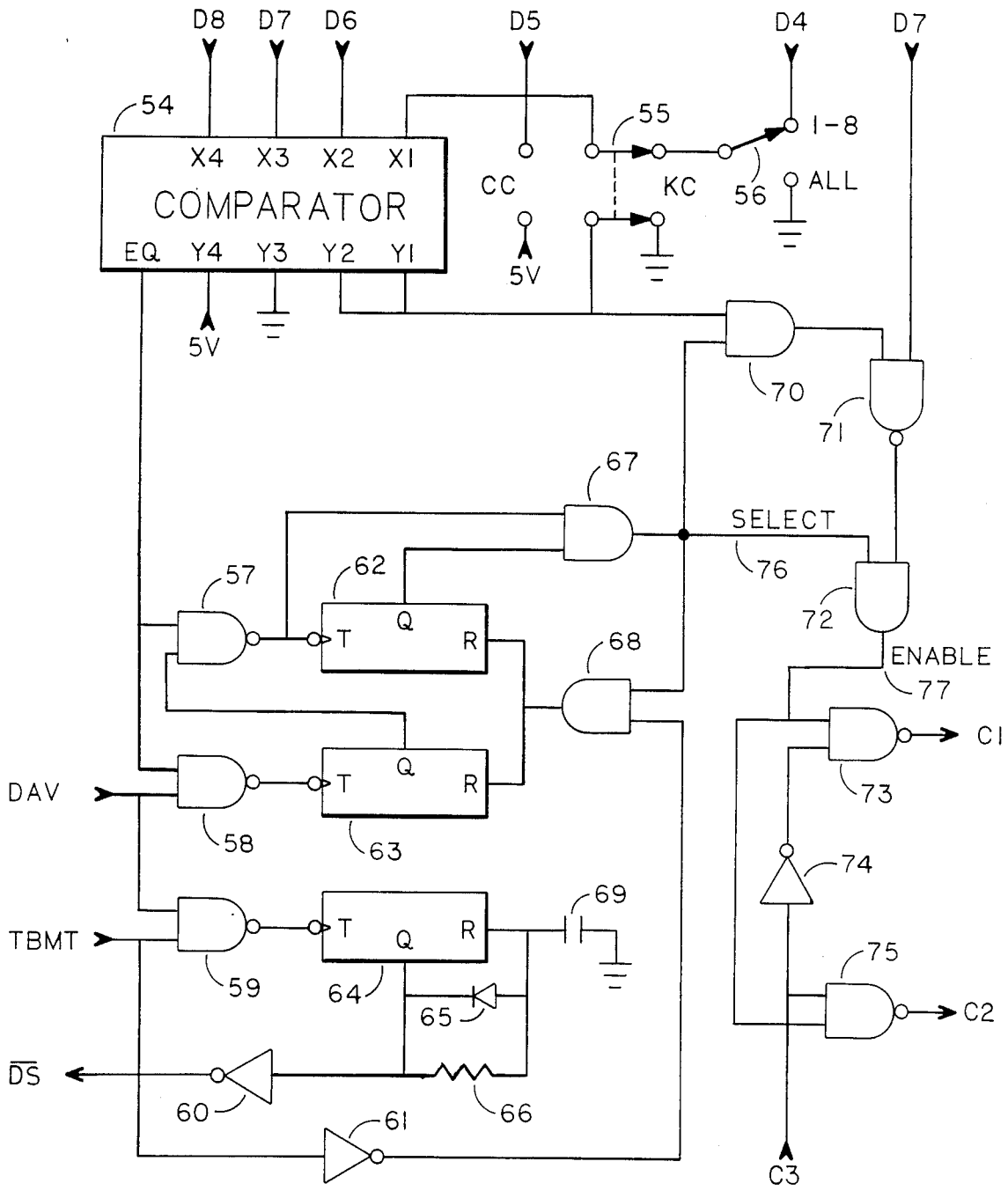
FIG. 2 is a schematic diagram of the Controller section of the MAC.

The Controller, shown in detail in FIG. 2, is complex because it must perform many functions. It must cause the Adder to add or subtract, as desired, the amount which has been entered into the Increment Selector by the person operating the device, to the first data byte following a Key On or Key Off Status Byte when the Key Change mode (switch 55 in position KC) has been selected by the operator. It must do this however, only if the key's channel number is in the range chosen by channel range select switch 56 with positions labeled 1–8 and ALL. In the Control Change mode (switch 55 in position CC) only the first data byte (with D7 low) following a Control Change Status Byte should be incremented. The restriction on D7 is due to the fact that the musician does not want the sustain pedal control number altered while other control numbers are being incremented.

To simplify the following discussion a data byte which should be incremented will be called a Select Data Byte and the Status Byte immediately preceding it will be called a Select Status Byte. In the Key Change on all channels mode a Select Status Byte would be 100Xcccc where ccc represents the bits of an arbitrary channel number and X, which is 1 for Key On and 0 for Key Off, is arbitrary. In the Key Change on channels 1–8 mode a Select Status byte would be 100X0ccc because the channel number would be greater than 8 if bit D4=1. In the Control Change mode a Select Status byte would be 1011cccc. Comparator 54 makes EQ high (logic 1) only when bits X1–X4 are equal respectively to bits Y1–Y4, i.e., EQ is high only if X=Y. The effect of comparator 54, mode switches 55 and 56, and the D bus connected as shown is to make EQ high only when a Select Status Byte is present on the D bus. However, D bus data is not valid while it is being clocked onto the bus. Since DAV goes high at the moment when the D bus data becomes valid we can be sure that a valid Select Status Byte is present on the D bus only if both EQ and DAV are high which would make the output of NAND gate 58 low. Therefore, the arrival of a valid Select Status Byte is indicated by a high to low transition at the input of toggle flip flop 63 which causes its Q output to go high. This causes the output of 57 to go low which causes the Q output of 62 to go high. We can now say that a Flag (Q output of 62) has been set to indicate that the next data byte will be a Select Status Byte. The setting of the Flag did not cause any change at the output of AND gate 67 because the T input of 62 went low before Q went high. Therefore Select 76 is still low after the Flag has been set.

The sole purpose of the circuit involving 59, 60, 64, 65, 66, and 69 is to provide a low going strobe (whose width depends upon the RC time constant of 65 and 69) on DS each time new valid data appears on bus D and the transmitter buffer becomes empty. The strobe will reset DAV and cause byte B, output from the adder, to be loaded into the transmitter buffer of the UART which begins transmission to the router at the rising edge of the strobe. TBMT also goes low at the rising edge of the strobe. This low signal which is inverted by 61 will cause flip flops 62 and 63 to be reset by AND gate 68 only if Select 76 is high.

Once the Flag has been set by the arrival of a Select Status Byte as explained above, the subsequent arrival of a valid Select Data Byte will make EQ low which will cause Select 76 to go high via the action of gates 57 and 67.

A high on Select indicates that the data present on bus D should be incremented unless D7 is high in the Control Change Mode. As explained above, this restriction is necessary to avoid the problem with the sustain pedal. It is therefore necessary to gate Select, D7, and Y1 with gates 70, 71 and 72 as shown. We can then say, with no restrictions, that whenever Enable 77 is high, the data on bus D must be incremented. The sign of the increment is plus when the logic state of control line C3 from the Increment Selector is high and minus when it is low. Enable 77 and C3, connected to 73, 74 and 75 as shown, will cause control signals to be sent to the Adder 51 via C1 and C2 which will cause it to add when Enable 77 and C3 are high, subtract when Enable 77 is high and C3 is low, and make B and D bus data equal when Enable 77 is low.

It will be appreciated that in FIG. 2, all grounds shown are logic 0 and the points labelled 5V are logic 1.

Figure 3:
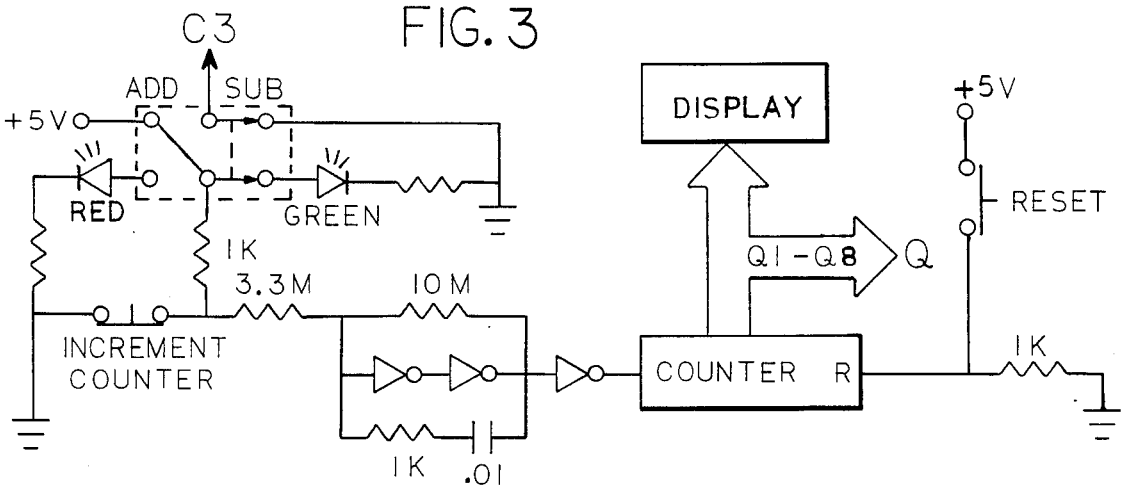
FIG. 3 is a schematic diagram of the Increment Selector used in the MAC to select the value and sign of the increment added to the address.

The Increment Selector is shown in more detail in FIG. 3. When the normally closed push button labeled Increment Counter is pressed, a debounced pulse causes byte Q, output by the binary counter to the Adder 51 and the display, to be incremented by one. The Reset button is used to clear the counter. The switch makes the logic state of C3 high when in the ADD position and low in the position labeled SUB as required. The red or green LED tells the operator, even in the dark, whether addition or subtraction is being performed, while the display indicates how much. The display may be a simple binary LED display or a 7 segment LED display with the usual decoders and drivers.

All chips not previously specified should preferably be high speed CMOS with part numbers beginning with 74HC. The toggle flip flops used in the Controller may be improvised from 74HC393 dual binary counters.

While this invention has been shown and described in connection with a particular preferred embodiment, it is apparent that various changes and modifiations, in addition to those mentioned above, may be made by those skilled in the art without departing from the basic featues of the invention. For example, a mere regrouping of components, e.g., gates 70 through 75 in FIG. 2 being considered a part of the Adder in FIG. 5 rather than part of the controller, could lead to a different block diagram and different schematics for each block. In such a case, the actual physical system would be unchanged but its description would be different. More simple subsystems (with reduced capabilities) could obviously be produced by eliminating various components from the preferred embodiment. For example, if one required a device capable of transposition only, then only one input and one output jack would be needed, and all routing, mode, and channel select switches, and several gates and connections could be eliminated. Although the controller in FIG. 2 is particularly well suited for use in the MIDI Address Converter of this invention, it will be understood that the controller or subsystems thereof, may be used for other applications with slight modifications if necessary. For example, it may be used to render normally incompatible digital devices compatible with each other by suitably altering the data being transmitted. Accordingly, it is intended to protect such subsystems and all other variations and modifications of the preferred embodiment which are within the true spirit and valid scope of this invention.

What is claimed is:

1. In a system of communication lines by which electronic signals are transmitted between digital music instruments interacting via the MIDI signal standard, the improvement comprising a digital electronic device interposed between such communication lines, which device includes electronic means selectively intercepting and re-routing the serial data being transmitted on said communication lines and simultaneously incrementing only those data bytes which are MIDI addresses of either musical keys or selected controls.

2. In a system of claim 1, the further improvement wherein said device utilizes logic gates to monitor and to perform logic functions on the data being processed by said device so that said device can be operated at baud rates of at least 250 kilobaud.

3. A system for transmitting electronic signals between musical instrument digital interfaces and enabling transposition of the music from one key to another, which system comprises:

(a) means for receiving and converting MIDI signals into normal parallel digital logic signals;

(b) means adapted on demand alternatively to add selected increments to the parallel digital logic signals or to subtract selected increments from the parallel digital logic signals;

(c) means enabling selection of the amount of said increments and the direction of the incremental change; and (d) means for converting the parallel digital logic signals back to MIDI signals.

4. A system of claim 3 wherein the conversion of the MIDI signals to parallel digital logic signals is effected by means of opto-isolators and a UART.

5. A system of claim 3 further including means enabling selection of the number of MIDI channels to which such increments are applied.

6. A system of claim 3 further including means enabling visual display of the amount of the increment selected.

7. A system of claim 3 further characterized by having the capability of operating at 250 kilobaud.

8. A system of claim 3 wherein the means for receiving and converting MIDI signals and the means for converting the parallel digital logic signals back to MIDI signals ar contained within a router section in which the incoming MIDI signals are converted to digital logic signals by diode-protected optoisolators, and the output stages can be routed as desired by switches through buffers to selected output jacks or to said increment means.

9. A digital electronic device which, when coupled to the communication lines between digital music instruments interacting via the internationally accepted signal standard known as MIDI, can selectively intercept and reroute the serial data being transmitted on said communication lines, while simultaneously incrementing only those data bytes which are MIDI Addresses of either keys or controls as desired; said device comprising:

a UART containing a serial input port, a serial output port, a parallel received data port, and a parallel transmitter data port; said parallel received data port being connected to an input data bus and said parallel transmitter port being connected to an output data bus;

clock means connected to said UART to cause said UART to operate at the MIDI standard baud rate;

increment selector means for generating electrically coded signals indicating an increment and its sign to be added to a MIDI Address when present on said input data bus;

adder means with augend connected to said input data bus, addend connected to said increment selector means by an increment bus whose data indicates said increment, and sum connected to said output data bus; and controller means coupled to and adapted to interact with said UART, said adder means, and said increment selector means, for effecting the desired MIDI address conversion.

10. A digital electronic device according to claim 9 further including:

a first signal line carrying a signal from said UART to said controller means to indicate when the data on said input data bus is valid;

a second signal line carrying a signal from said UART to said controller means to indicate when the transmitter buffer of said UART is ready to accept new data;

a third signal line on which a low going strobe signal sent by said controller means to said UART will cause the output byte from said adder means to be loaded into said transmitter buffer of said UART and transmission to begin;

first and second control lines by which said controller means controls said adder means; and a fourth signal line by which said increment selector means sends a signal to said controller means indicating the sign of said increment.

11. A digital electronic device according to claim 10 wherein said controller means includes:

monitor means for determining when a select status byte is present on said input data bus;

select generating means that outputs a logic 1 when a select data byte is present on said input data bus;

strobe generating means for generating a strobe signal to cause said UART to begin transmission of data present on said output data bus; and adder control means for controlling said adder means.

12. A digital electronic device according to claim 11 wherein said monitor means includes a channel range select switch, a mode select switch, logic zero, logic one, a comparator, and first connection means connecting them together and to said input data bus so that a logic 1 is produced at the EQUAL output of the comparator when a select status byte is present on said input data bus, such EQUAL output of the comparator being the output of the monitor means.

13. A digital electronic device according to claim 12 wherein said select generating means includes first and second NAND gates, first and second toggle flip flops, first and second AND gates, a first inverter gate, said output of the monitor means, and second connection means connecting them together and to said first signal line and to said second signal line so that the output of said first AND gate is caused to be a logic 1 when a select data byte is present on said received data bus, such output of said first AND gate being the output of the select generating means.

14. A digital electronic device according to claim 13 wherein said strobe generating means includes a third NAND gate, a third toggle flip flop, a capacitor, a diode, a resistor, a second inverter gate, and third connection means connecting them together and to said second signal line and to said third signal line so that a low going strobe signal appears on said third signal line when a logic 1 appears on said first and said second signal lines simultaneously.

15. A digital electronic device according to claim 14 wherein said adder control means includes third and fourth AND gates; fourth, fifth and sixth NAND gates; a third inverter; bit 7 on said input data bus; said output of said select generating means; and a fourth connection means connecting them together and to the terminal on said mode select switch that is equal to a logic 0 when in the key change mode, and to said first control line, said second control line, said fourth signal line and said adder means so that the adder means adds or subtracts said increment to or from said input data bus data only when a select data byte is present on said input data bus.

16. A digital electronic device according to claim 15 further including routing means for routing signals from a standard MIDI input jack to said serial input port and from said serial output port to a selected output jack.

17. A digital electronic device according to claim 9 wherein said controller means includes:

monitor means for determining when a select status byte is present on said input data bus;

select generating means that outputs a logic 1 when a selected data byte is present on said input data bus; and strobe generating means for generating a strobe signal to cause said UART to begin transmission of data present on said output data bus;

and wherein said device includes adder control means for controlling said adder means.

18. A digital electronic device according to claim 17 further including routing means for routing signals from a standard MIDI input jack to said serial input port and from said serial output port to a selected output jack.

19. A controller adapted for use in controlling digital electronic devices receiving serial data and containing means adapted on demand alternatively to add selected increments to received digital logic signals or to subtract selected increments from received digital logic signals, said controller comprising:

(a) monitor means for determining when a select status byte is received;

(b) select generating means that outputs a logic 1 when a select data byte is received;

(c) strobe generating means for generating a strobe signal to cause transmission of data from a transmitter data source; and (d) control means adapted to cause said means to add or subtract the selected increment to or from the data from the received digital logic signals only when a select data byte is received.

20. A controller according to claim 19 wherein:

said controller includes a channel range select switch, a mode select switch, logic zero, logic one, a comparator, and first connection means connecting them together so that a logic 1 is produced at the EQUAL output of the comparator when a select status byte is present in the received data signal, such EQUAL output of the comparator being the output of the monitor means;

said select generating means includes first and second NAND gates, first and second toggle flip flops, first and second AND gates, a first inverter gate, said output of the monitor means, and second connection means connecting them together and to said first signal line and to said second signal line so that the output of said first AND gate is caused to be a logic 1 when a select data byte is present in the received data signal, such output of said first AND gate being the output of the select generating means;

said strobe generating means includes a third NAND gate, a third toggle flip flop, a capacitor, a diode, a resistor, a second inverter gate, and third connection means connecting them together and to said second signal line and to said third signal line so that a low going strobe signal appears on said third signal line when a logic 1 appears on said first and said second signal lines simultaneously; and said control means includes third and fourth AND gates; fourth, fifth and sixth NAND gates; a third inverter; bit 7 on said received data bus; said output of said select generating means; and a fourth connection means connecting them together and to the terminal on said mode select switch that is equal to a logic 0 when in the key change mode, and to said first control line, said second control line, said fourth signal line and said adder means so that the adder means adds or subtracts said increment to or from said digital logic signals only when a select data byte is present in the received digital logic signal.

* * * * *